US005602574A

United States Patent [19]

Williams

[11] Patent Number: 5,602,574

[45] Date of Patent: Feb. 11, 1997

[54] MATRIX PEN ARRANGEMENT FOR INKJET PRINTING

[75] Inventor: Kenneth R. Williams, Vancouver, Wash.

[73] Assignee: Hewlett-Packard Company, Palo Alto, Calif.

[21] Appl. No.: 299,473

[22] Filed: Aug. 31, 1994

[51] Int. Cl.[6] ..... B41J 2/21; B41J 2/175

[52] U.S. Cl. ..... 347/43; 347/86

[58] Field of Search ..... 347/40, 43, 48, 347/37, 68, 86

[56] References Cited

U.S. PATENT DOCUMENTS

| | | | |
|---|---|---|---|
| 4,447,820 | 5/1984 | Terasawa | 347/12 |
| 4,571,600 | 2/1986 | Hara | 347/32 |
| 4,683,481 | 7/1987 | Johnson . | |
| 4,812,859 | 3/1989 | Chan et al. . | |
| 4,872,027 | 10/1989 | Buskirk et al. . | |
| 4,940,998 | 7/1990 | Asakawa . | |
| 5,008,689 | 4/1991 | Pan et al. . | |
| 5,025,271 | 6/1991 | Baker et al. . | |
| 5,040,001 | 8/1991 | Dunn et al. . | |
| 5,198,834 | 3/1993 | Childers et al. . | |
| 5,278,584 | 1/1994 | Keefe et al. . | |
| 5,371,531 | 12/1994 | Rezanka et al. | 347/43 |
| 5,455,607 | 10/1995 | Rhoads et al. | 347/8 |
| 5,455,610 | 10/1995 | Harrington | 347/43 |

*Primary Examiner*—Benjamin R. Fuller
*Assistant Examiner*—Thinh Nguyen
*Attorney, Agent, or Firm*—Flory L. Martin

[57] ABSTRACT

A matrix arrangement for inkjet pens used in inkjet printing mechanisms provides increased throughput and a narrower product than the traditional pen arrangements laying side-by-side along the scanning axis. The matrix inkjet cartridge has at least two chambers perpendicular to the scanning axis. For example, a two-by-two matrix arrangement in a four pen cartridge system requires less distance for all of the nozzles to traverse the entire print zone. Thus, throughput, often measured in pages per minute, is increased. Moreover, the overall product width may be decreased to provide a more compact product for consumers. A method is also provided of dispensing ink using an inkjet printing mechanism, as well as a method of delivering ink through an inkjet cartridge where ink is extracted from storage chambers through ports located on opposing sides of a plane parallel to the scanning axis.

16 Claims, 3 Drawing Sheets

FIG. 4
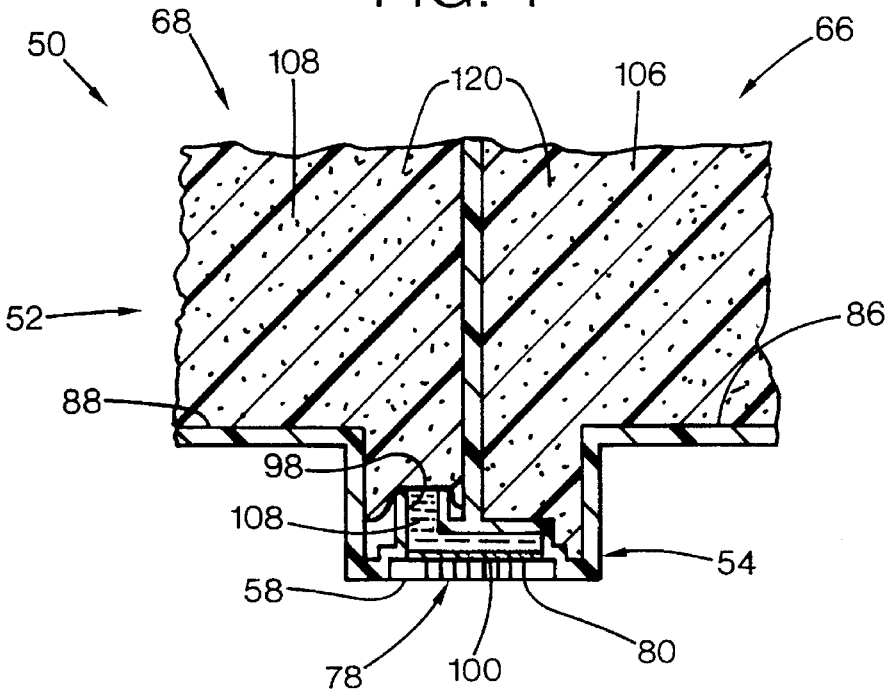
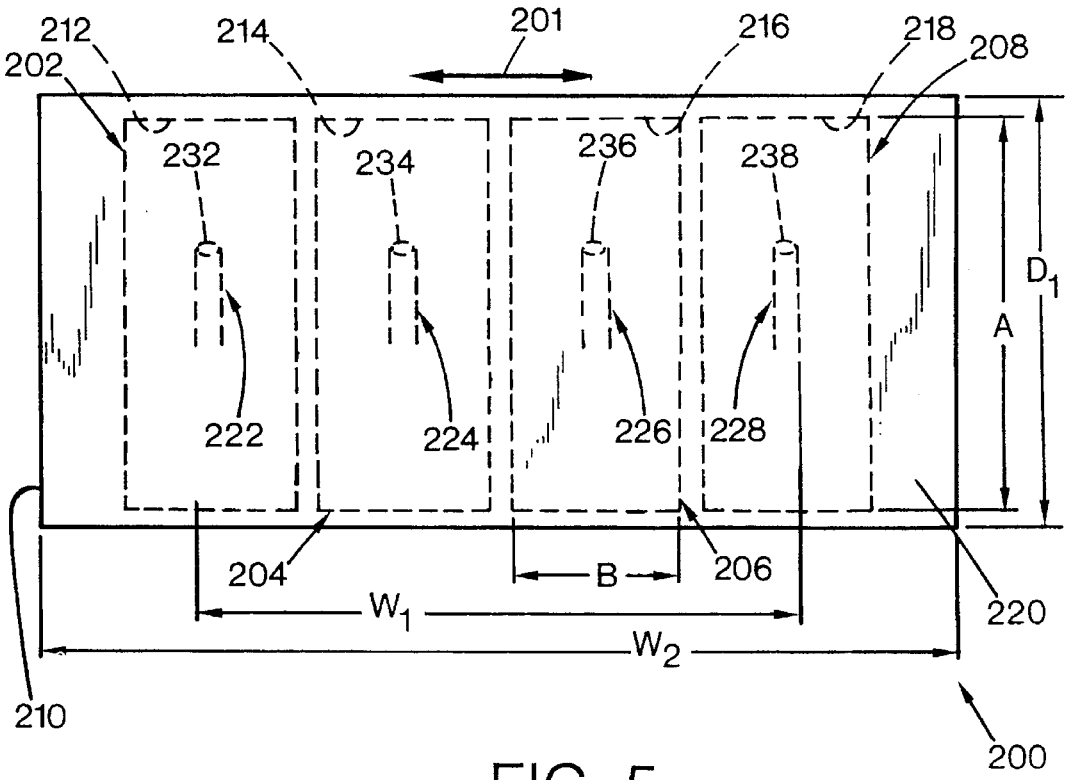
FIG. 5
PRIOR ART

MATRIX PEN ARRANGEMENT FOR INKJET PRINTING

FIELD OF THE INVENTION

The present invention relates generally to a pen arrangement for inkjet printing that minimizes product width and increases printing throughput, as well as a method of dispensing ink from an inkjet printing mechanism.

BACKGROUND OF THE INVENTION

Inkjet printing mechanisms may be used in a variety of different products, such as plotters, facsimile machines and inkjet printers, to print images using a colorant, referred to generally herein as "ink." Inkjet printing mechanisms typically have a printhead which is propelled from side to side across a print media, such as paper, with the printhead being controlled to selectively deposit ink in a desired pattern on the page. Some inkjet print mechanisms carry an ink cartridge with a full supply of ink back and forth across the sheet. Other inkjet print mechanisms, known as "off-axis" systems, propel only a small ink supply with the printhead cartridge across the print zone, and store the main ink supply in a stationary reservoir, which is located "off-axis" from the path of printhead travel. Typically, a flexible conduit is used to convey the ink from the off axis main reservoir to the printhead cartridge. In multi-color cartridges, several printheads and reservoirs are combined into a single unit, with each reservoir/printhead combination for a given color being referred to as a "pen."

In the past, inkjet pens have been arranged in a side-by-side fashion, for example, as shown schematically in FIG. 5 for a multi-color cartridge 200. The cartridge 200 has pens are arranged in a one-by-four matrix, side-by-side and parallel to a scanning axis, as indicated by arrow 201. The scanning axis 201 defines the path of travel of the printhead carriage over the print zone. The cartridge 200 has four pens, specifically black ("K"), magenta ("M"), yellow ("Y") and cyan ("C") pens 202, 204, 206 and 208, with a casing 210 defining pen reservoirs 212, 214, 216, 218, respectively. An orifice plate 220 may be used to define black, magenta, yellow and cyan ink-ejecting nozzle sets 222, 224, 226, 228 for the respective pens 202, 204, 206 and 208. Ink feed or inlet orifices, 232, 234, 236, 238 supply ink from reservoirs 212, 214, 216, 218 to the ink ejection mechanism (not shown) of the respective nozzle sets 222, 224, 226, 228.

Between each ink feed orifice 232, 234, 236, 238 and its associated nozzle set 222, 224, 226, 228 lies an ink ejection mechanism that may take on a variety of different forms known to those skilled in the art, for instance, using piezoelectric or thermal printhead technology. For purposes of illustration, two earlier thermal ink ejection mechanisms are shown in U.S. Pat. Nos. 5,278,584 and 4,683,481, both assigned to the present assignee, Hewlett-Packard Company. In a thermal system, a barrier layer (not shown) containing ink channels and vaporization chambers is located between the orifice plate 220 and a substrate layer (not shown). This substrate layer typically contains linear arrays of heater elements, such as resistors, which when energized, heat the ink within the vaporization chambers to eject an ink droplet from a discrete nozzle associated with the energized resistor. By selectively energizing the resistors, the ink is expelled in a pattern on the print media to form a desired image (e.g., picture, chart or text).

The minimum width of these earlier multi-pen assemblies is limited by the ink pressure regulation system feeding each group of nozzles. Typical ink pressure regulation systems are often constructed using foam, for instance, or using a resilient bladder system. In one typical earlier system, such as cartridge 200 of FIG. 5, the depth $D_1$ of the casing 210 is about 45 mm, and each of the reservoirs 212–218 has a width of approximately 18.5 mm, with a spacing of 2.5 mm being required between adjacent reservoirs. Thus, the overall width $W_1$ between the outer most edge of the black nozzle set 222 and the outer most edge of the cyan nozzle set 228 is about 66 mm. Using a typical spacing of 9.3 mm for distance between the two outermost reservoirs 222, 228 and the outboard edges of the casing 210, the overall width $W_2$ of the pen casing 210 is about 100 mm. Even if the width of each pressure regulation system 222–228 is on the order of 15 mm, this arrangement makes it very difficult to feed ink toward the central line of the carriage, while providing a narrow column-to-column nozzle spacing. The wide column-to-column nozzle spacing of cartridge 200 decreases the throughput (e.g., pages per minute) of the printing mechanism because the printhead must traverse a longer path to scan each printhead over the entire print zone. Unfortunately, this longer scanning path also increases the product width.

Another system to minimize product width arranges the pens in a four-story stack, extending radially away from the axis, typically in a vertical direction. Such a vertical array suffers its own set of difficulties. For example, the printhead carriage must now be of a heavier construction to handle the moment of inertia created by such a top-heavy design. Also, the ink from the uppermost reservoirs if used infrequently, may be subject to drying and clogging within the feed passageways. Furthermore, the ink reservoirs of such a system are difficult to access for replenishing the ink supply. To accommodate a four-story pen stack, these products are usually taller than other products using pen 200, for instance, which detracts from the esthetic appeal of four-story pen units.

Thus, the earlier pen arrangement systems proposed have inadequately addressed the needs of increasing throughput and minimizing product width, as illustrated above with respect to an inkjet printer. Increased throughput, often measured in pages per minute, is preferred by consumers. Larger equipment is usually heavier and more costly to manufacture and ship, as well as being undesirable to some consumers who prefer more compact equipment with a smaller footprint, i.e. requiring a smaller area to rest upon a work surface or desk.

SUMMARY OF THE INVENTION

According to one aspect of the present invention, an inkjet printing mechanism has a carriage system that provides relative movement between a cartridge and a print media, with the relative movement occurring along a scanning axis. The mechanism also has an inkjet cartridge that includes a printhead body, received by the carriage system, and a printhead portion. The printhead portion has at least two nozzle sets that selectively eject ink therethrough. The printhead body has at least two ink storage chambers each in fluid communication with a respective one of the nozzle sets. The storage chambers are arranged in a matrix with at least two chambers being arranged perpendicular to the scanning axis.

According to another aspect of the present invention, a replaceable pen cartridge, which may be constructed as described above for the inkjet cartridge, is also provided. According to an illustrated embodiment, the cartridge has four reservoirs, arranged in a two-by-two matrix.

According to another aspect of the present invention, a method is provided of dispensing ink using an inkjet printing mechanism. The method includes the step of supplying ink to at least two ink storage chambers within an inkjet cartridge having a corresponding number of nozzle sets, with each nozzle set being in fluid communication with a respective one of the chambers. In a scanning step, the cartridge is moved across a print media along a scanning axis. In an ejecting step, ink supplied from the cartridge nozzles is selectively ejected during scanning to record an image on the print media. Prior to the supplying step, the chambers arranged in a matrix with at least two chambers being arranged perpendicular to the scanning axis.

According to another aspect of the present invention, a method is provided of delivering ink through an inkjet cartridge. The method includes the steps of storing different colors of ink within plural ink storage chambers of the inkjet cartridge, and selectively ejecting ink from plural nozzle sets of the cartridge. Preferably, each nozzle set ejects a single one of the different colors, with each nozzle set having discrete nozzles located to each side of a first plane. Prior to the ejecting step, the nozzle sets are supplied with ink by extracting stored ink from the plural ink storage chambers through ports located on opposing sides of the first plane.

An overall goal of the present invention is to provide a narrower inkjet printing mechanism that is more compact, lighter weight, and more economical to manufacture and ship than equipment using earlier pen arrangements.

An further goal of the present invention is to provide an inkjet printing mechanism that has faster throughput, typically measured in pages per minute, than products using earlier pen arrangements.

Another goal of the present invention is to provide methods of dispensing ink using an inkjet printing mechanism and of delivering ink through an inkjet cartridge.

BRIEF DESCRIPTION OF THE DRAWINGS

FIG. 4 is a partially diagrammatic, side elevational sectional view taken along lines 4—4 of FIG. 3.

FIG. 5 is a diagrammatic bottom plan view of a prior art inkjet pen cartridge arrangement.

DETAILED DESCRIPTION OF A PREFERRED EMBODIMENT

Figure 1:
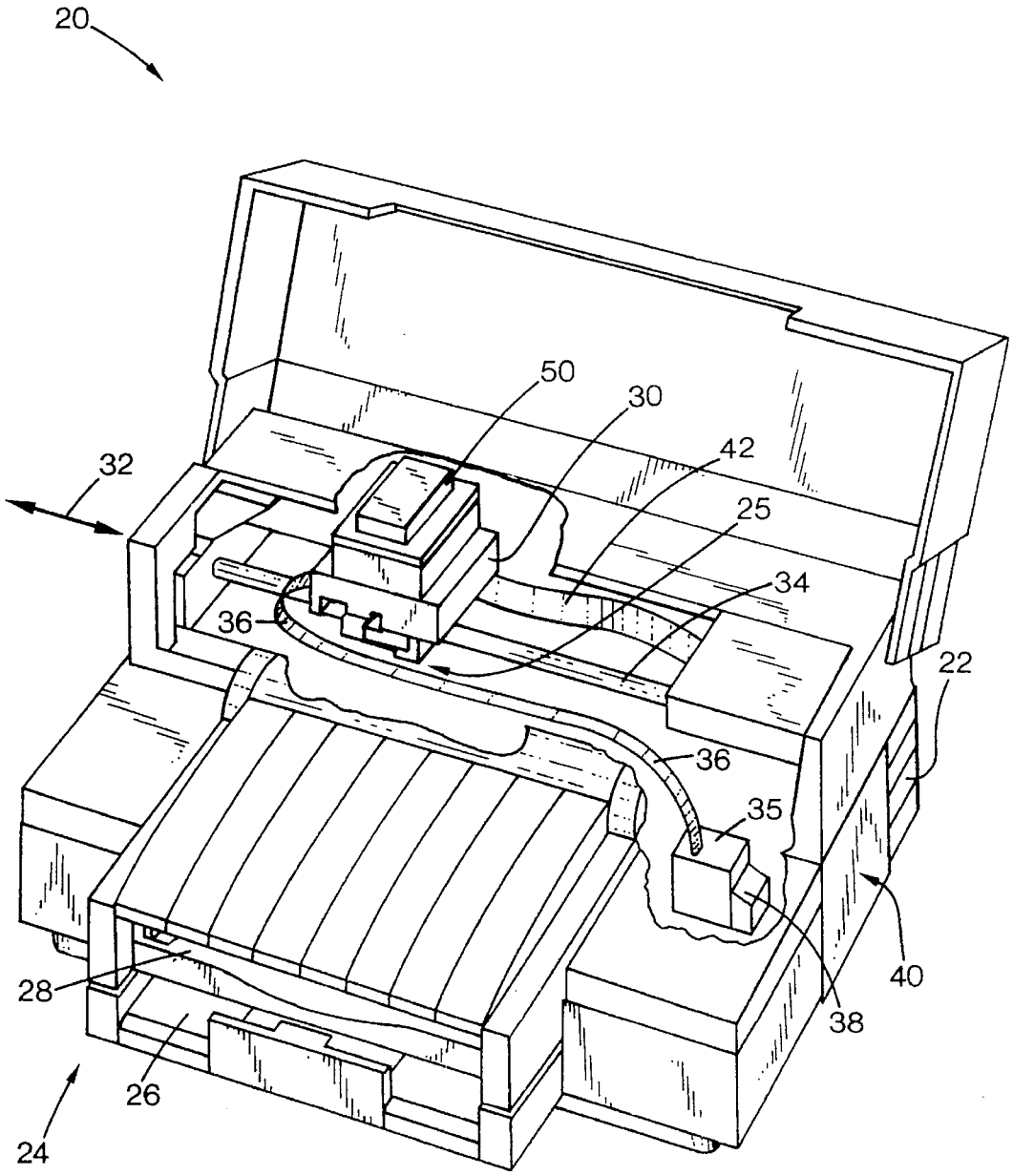
FIG. 1 is a partially cut away perspective view of one form of an inkjet printing mechanism, here an inkjet printer, using one form of a matrix pen inkjet cartridge of the present invention.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other setting. Other inkjet printing mechanisms may embody the present invention, such as plotters, portable printing units, and facsimile machines, to name a few, but for convenience the concepts of the present invention are illustrated in the environment of an inkjet printer 20.

While it is apparent that the printer components may vary from model to model, the typical inkjet printer 20 includes a chassis 22 and a print media handling system 24 for supplying a print media to the printer 20. The print media may be any type of suitable sheet material, such as sheets of paper, card-stock, foils, mylar, transparencies, and the like, but for convenience, the illustrated embodiment is described using paper as the print media. The print media handling system 24 may include a conventional arrangement of a drive motor coupled to a series of rollers (not shown) for delivering the sheets from a feed tray 26, into a print zone 25, and then into an output tray 28.

A carriage assembly 30 is driven from side to side along a scanning axis, as indicated by the double-headed arrow 32, across the print zone 25. The carriage assembly 30 is driven along a guide rod 34 by, for example, a conventional drive belt/pulley and motor assembly (not shown). A fluid colorant, referred to herein generally as "ink," may be delivered for printing to the carriage 30 from a supply stored in a main reservoir 35 via a flexible ink transport conduit or tubing system 36. The conduit 36 may be constructed in a conventional manner from a variety of different elastomers and plastics, known to those skilled in the art. While the main reservoir 35, conduit 36, and carriage 30 may be designed for monochromatic printing in a single color, black for instance, the concepts of the present invention are particularly well suited to multicolor printing, such as combinations of cyan, yellow, magenta, and possibly true black (as opposed to composite black which is printed from a combination of cyan, yellow and magenta). For convenience, a four-color embodiment(cyan, yellow, magenta, and true black, also referred to herein as "CYMK," where "K" refers to true black) of printer 20 is used to illustrate the concepts of the present invention.

A variety of different systems may be implemented to propel the ink from the reservoir 35 to the carriage 30. For example, a conventional piston actuator assembly 38 may extend into the reservoir 35 to three ink into the conduit 36. Other methods of urging the ink through conduit 36 include the use of capillary action, a gravity feed system provided by mounting the reservoir 35 at a location which is elevated above the carriage 30, or through pumping action, for instance provided by a peristaltic pump (not shown).

A controller 40, which may be located in the chassis 22 adjacent the area indicated, generally receives instructions from a computer (not shown), such as a personal computer. Personal computers, their input devices, such as a keyboard and/or a mouse, and computer monitors are all well known to those skilled in the art. In response, the controller 40 instructs the print media handling system 24 to selectively advance the sheet media through the print zone 25, and the carriage drive mechanism to selectively scan the carriage 30 across the print zone 25. The controller 40 generates a print control signal that is sent to the carriage 30 via a flexible electrical conductor strip 42.

Figure 3:
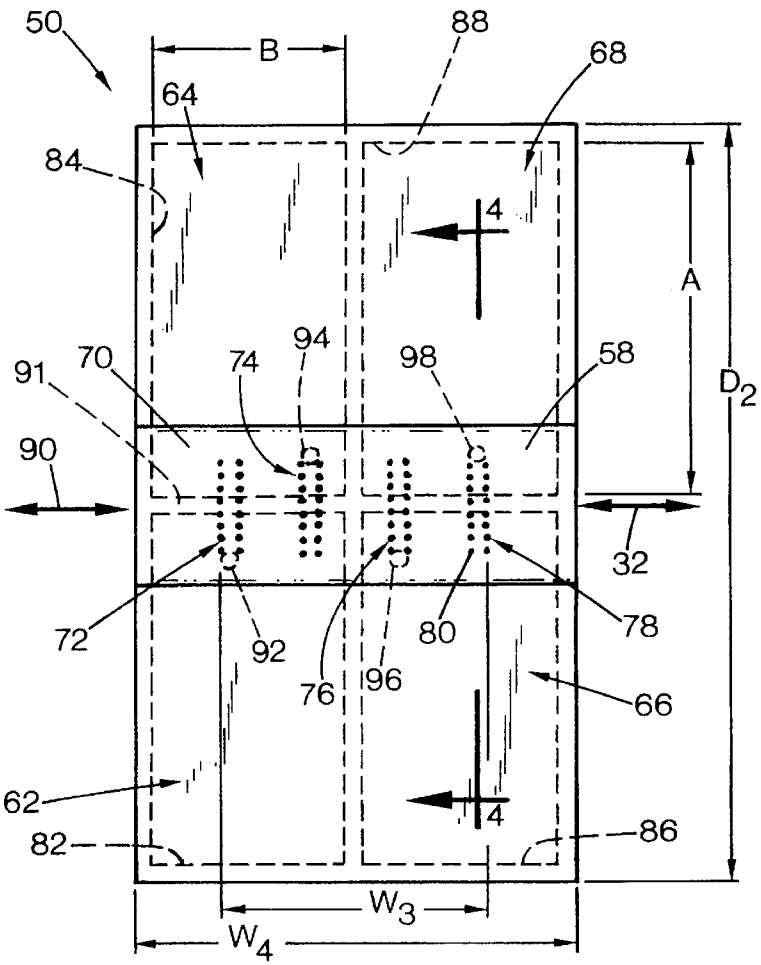
FIG. 3 is a bottom plan view taken along lines 3—3 of FIG. 2.
Figure 2:
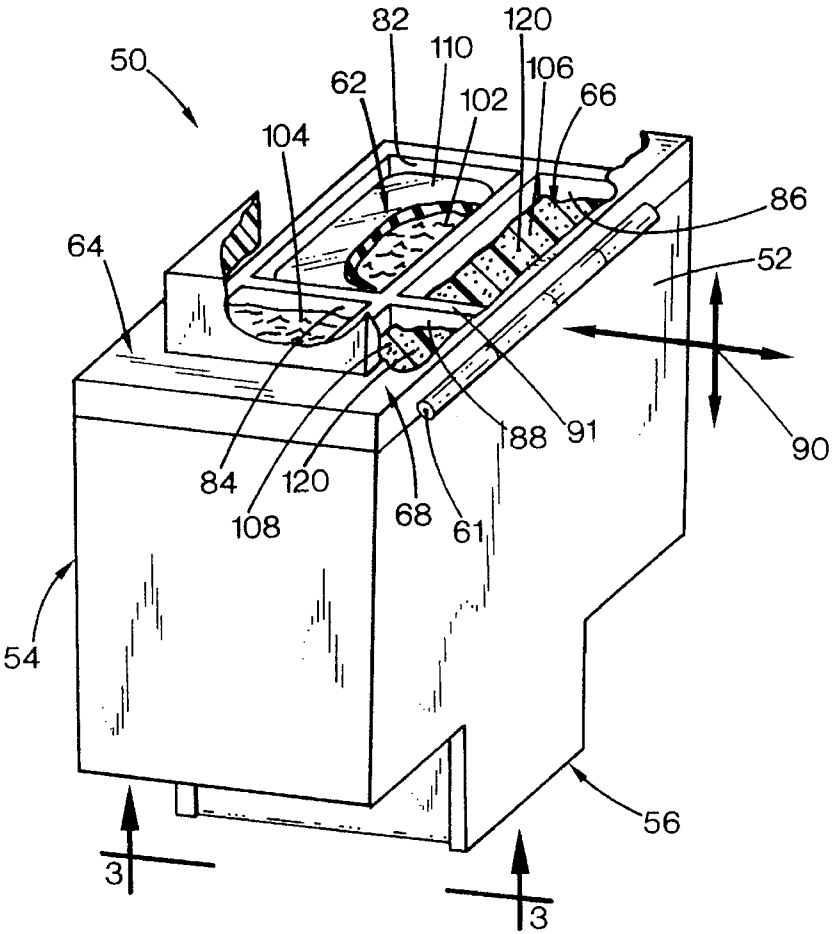
FIG. 2 is an enlarged cut away perspective view of the matrix pen inkjet cartridge of FIG. 1.

Referring also to FIGS. 2 and 3, the printer 20 has a printhead reservoir assembly or inkjet cartridge 50 that is received within the carriage 30. To increase throughput and minimize the width of an inkjet printing mechanism, such as the printer 20, one of the constraining features in a multi-pen carriage arrangement is the printhead design. For example, in determining the impact on product width of a given pen design, the sum of two dimensions is considered: (1) the overall carriage width, and (2) the maximum column-to-column distance between linear nozzle arrays of adjacent pens. The impact of a given pen design on throughput is determined by the maximum column-to-column nozzle spacing. Given these considerations, to improve throughput and minimize product width, there are two design approaches which may be used. First, the carriage width may be minimized, and second, the nozzle column-to-column spacing may be minimized. The illustrated cartridge 50 addresses the both of these pen design aspects.

The illustrated inkjet cartridge 50 has a printhead casing or body 52 which has an upper ink receiving portion 54 fluidicly coupled to a printhead portion 56. The lower extremity of the printhead portion 56 terminates in a printhead face 58, as best shown in FIG. 3. The upper casing portion 54 may be permanently sealed by a printhead lid member 60, or the lid member 60 may be attached to the body 52 by a hinge member 61, or a structurally equivalent attachment mechanism, to be selectively openable and resealable for refilling. The multicolor inkjet cartridge 50 has four pens, specifically a black ("K") pen 62, a magenta ("M") pen 64, a yellow ("Y") pen 66 and a cyan ("C") pen 68. As used herein, the term "pen" generally refers to a printhead and reservoir assembly coupled together to provide ink flow of a specific color.

The printhead face 58 may be surfaced with a conventional orifice plate 70 used to define black, magenta, yellow and cyan ink-ejecting nozzle sets 72, 74, 76 and 78 for the respective pens 62, 64, 66 and 68. The nozzle sets 72–78 are illustrated as comprising two linear arrays of discrete nozzles, such as nozzle 80, with the arrays extending substantially perpendicular to the scanning axis 32. In the past, the inkjet pens were arranged in a side-by-side fashion, for example, as shown schematically in FIG. 5 for the multicolor cartridge 200. To minimize the column-to-column nozzle spacing, preferably, the printhead casing 52 is configured to define a plurality of ink storage chambers therein, such as reservoirs or chambers 82, 84, 86 and 88.

The printhead casing 52 may be sectioned by a plane, indicated in FIGS. 2 and 3 at item 90, which may lie generally parallel to the scanning axis 32, and coplanar with a wall 91 separating chambers 82, 86 from chambers 84, 88. The casing 52 is preferably configured to define ink feed inlet orifices or ports 92, 94, 96, 98 that provide a passageway to deliver ink from reservoirs 82, 84, 86 and 88 to the ink ejection mechanisms (not shown) of the respective nozzle sets 72, 74, 76 and 78. Preferably, the inlet ports 92, 94, 96, 98 are located on opposite sides of plane 90, with adjacent nozzle sets, such as 72 and 74, being fed from opposing sides of plane 90, here by ports 92 and 94.

Between each feed orifice 92, 94, 96, 98 and its associated nozzle set 72, 74, 76 and 78, lies an ink ejection mechanism that may take on a variety of different forms known to those skilled in the art, for instance, using piezo-electric or thermal printhead technology. For purposes of illustration, earlier thermal ink ejection mechanisms are shown in U.S. Pat. Nos. 5,278,584, 5,008,689 and 4,683,481, both assigned to the present assignee, Hewlett-Packard Company. In a thermal ink ejection mechanism 100, shown schematically in FIG. 4 for the cyan pen 68, a barrier layer containing ink channels and vaporization chambers may be located between the orifice plate 70 and a substrate layer. This substrate layer typically contains linear arrays of heater elements, such as resistors, which when energized, heat the ink within the vaporization chambers to eject an ink droplet from a discrete nozzle, such as nozzle 80, associated with the energized resistor. Upon energizing a selected resistor, a bubble of ink is formed and then ejected from the nozzle on to a portion of the sheet located in the print zone 25 adjacent the nozzle. By selectively energizing the resistors in response to the signal received from the controller 40 via conductor strip 42, the ink is expelled in a pattern on the print media to form a desired image (e.g., picture, chart, text, etc.).

It will become apparent to those skilled in the art from the following description that the principles of the illustrated cartridge 50 may be embodied in a variety of different pen types, each of which are suitable for use in inkjet printing mechanisms. FIG. 2 illustrates several such embodiments, with the reservoirs 82, 84, 86 and 88 storing the respective black ("K") ink 102, magenta ("M") ink 104, yellow ("Y") ink 106, and cyan ("C") ink 108, in several different manners. For example, the off-axis ink supply system of printer 20 may have a permanent or semi-permanent printhead unit, as shown in FIG. 1. In this embodiment, the inkjet cartridge 50 carries only a small supply of ink, such as in reservoir 84 (FIG. 2), with the main supply being stored in the stationary reservoir 35. A back-pressure system to provide a negative pressure to the ink supply may be provided at the main reservoir 35 or at the cartridge 50 to prevent ink from drooling out of the nozzles. A variety of suitable back-pressure systems are known to those skilled in the art and commercially available in inkjet cartridges, such as the cartridges sold by the present assignee, Hewlett-Packard Company, for its DeskJet® series of inkjet printers.

Alternatively, each reservoir may be filled or refilled with several replaceable reservoir units, such an ink container 110 housing a supply of black ink 102 within chamber 82. The ink container 110 may be of a rigid or flexible plastic, rubber or elastomer bladder structure, a foil bag configuration, or other structurally equivalent container configuration that contains or provides a back-pressure system to prevent ink drool. For example, by using the illustrated elastomeric bladder container 110 with a resistance to collapsing as the ink 102 is depleted, a suitable negative pressure is maintained to prevent drool.

As another example, the illustrated cartridge 50 may be used as a replaceable pen, without the main reservoir 35, so the printhead and main ink supply are both carried by carriage 30. FIG. 2 in part illustrates such an embodiment which may comprise foam-filled reservoirs, such as the foam 120 within reservoirs 86 and 88, which are saturated with the respective inks 86 and 88. The foam 120 provides the reservoirs with a back-pressure system through capillary action, as described at length in U.S. Pat. No. 5,025,271, for instance. One suitable type of material for foam 120 is a polyurethane reticulated foam, although other types of foam may be used. While the cartridge 50 illustrated in FIG. 2 is a composite configuration used to show these various manners of implementing the concepts of the present invention, it is apparent that in most practical configurations, each of the reservoirs would be filled in an identical fashion.

The reservoirs 82–88 and nozzle sets 72–78 are arranged in a matrix configuration, with at least two reservoirs, such as 82 and 84, or 86 and 88, arranged to be perpendicular to the scanning axis in a two-by-one matrix. As shown, the four pens 62–68 are advantageously arranged in a two-by-two matrix, with at least two reservoirs (specifically, 82 and 86, or 84 and 88) parallel to the scanning axis 32, and at least two reservoirs (specifically 82 and 84, or 86 and 88) perpendicular to the scanning axis. It is apparent that other matrix arrangements are also possible. For example, although perhaps a less preferred embodiment than shown in FIGS. 2 and 3, the four pens 62–68 may be arranged in a matrix with the three color pens 66–68 oriented parallel to the scanning axis 32, and the black pen 62 extending along either the front or rear wall of the color pens, perhaps in a rectilinear cross sectional shape having a major axis parallel to the scanning axis 32.

Another suitable configuration employs two cartridges, each having a two-by-one matrix arrangement. For example, one cartridge may have the black pen 62 and the magenta pen 64, while the second cartridge may have the yellow pen 66 and the cyan pen 68. Preferably, these two-by-one matrix cartridges have their respective chambers 82, 84 and 86, 88 oriented relative to the scanning axis 32 as shown in FIGS. 2–4 tier pens 62, 64 and 66, 68, respectively.

A comparison of FIGS. 3 and 5 illustrates the minimization of the overall column-to-column nozzle spacing which has been achieved using the pen arrangement system of cartridge 50, while maintaining ink volume. The size the reservoirs in cartridges 50 and 200 is listed as dimension A for depth, and dimension B for width. In the illustrated cartridge 50, these dimensions have been made the same as for cartridge 200, with the depth A being about 37 mm, the width B being about 18.5 mm. Assuming that cartridge 50 has the same nozzle dimensions, and the same 2.5 mm reservoir wall thickness used in the earlier cartridge 200, then the overall width $W_3$ of nozzle sets 72–78 is about 27.5 mm. This of 38.5 mm decrease in the overall nozzle width dimension ($W_3$) in contrast with the 66 mm $W_1$ dimension for cartridge 200, is achieved due to the narrower column-to-column nozzle spacing of the matrix pen arrangement in cartridge 50. The matrix arrangement provides over a 41% decrease in width from the left most nozzle to the right most nozzle. This feature results in less carriage over-travel being required to traverse the nozzle sets 72–78 over the entire print zone 25 (typically about 200 mm in maximum width) that required for cartridge 200. Thus, using the cartridge 50, the throughput is increased and the overall product width of printer 20 has been advantageously minimized over that possible using the prior art cartridge 200.

Another contributing factor to reducing the width of printer 20 is the reduction in the width of the printhead carriage 30 achieved using the matrix cartridge. Given the sizing assumptions described above, the cartridge 50 has a depth dimension $D_2$ of about 81.5 mm, and width dimension $W_4$ of about 44.5 mm. The slight increase in the depth of cartridge 50 with respect to cartridge 200 is not a particularly critical dimension in affecting the overall dimensions of most products employing inkjet printing mechanisms. However, reduction of the carriage width significantly impacts the overall product width. This $W_4$ dimension is a significant decrease from the overall width $W_2$ of 100 mm for cartridge 200 in FIG. 5, specifically, over a 65% decrease in cartridge width. This width reduction translates to a true 65.5 mm reduction of product width.

Another solution to minimizing the printhead cartridge width may be to stack all of the pens horizontally in a direction perpendicular to the scanning axis, rather than parallel as shown in FIG. 5. Such a system is preferred for a two pen system, a two-by-one pen matrix comprising only pens 62 and 64, for instance. However, when this concept is extended to a four pen system it suffers several practical limitations. For example, the print swath increases in width with a four-by-one matrix pen, so four times as much of the print media must be held substantially flat under the printhead to maintain high quality printing. To accommodate a four pen swath, very accurate control of the print media is required, which is presently expensive to implement and maintain. Moreover, such a four-by-one cartridge may encounter difficulty in maintaining print quality when using varying thickness of media, such as the relatively thicker envelopes versus the thinner transparencies. These print swath related problems are not be encountered in the preferred two-by-one pen matrix comprising only pens 62 and 64, or pens 66 and 68, for instance.

In operation, a method is also provided of dispensing ink using an inkjet printing mechanism. The method includes the steps of supplying ink to at least two ink storage chambers for a cartridge having a corresponding number of nozzle sets, with each nozzle set in fluid communication with a respective one of the chambers. For cartridge 50 with four chambers 82–88, fluid communication with the nozzle sets 75–78 is provided by inlet ports 92–98, respectively. In a scanning step, the cartridge is scanned across the print media along the scanning axis 32. In an ejecting step, the supplied ink is selectively ejected from the cartridge nozzles 75–78 during scanning to record an image on the print media. Prior to the supplying step, in an arranging step, the chambers are arranged in a matrix with at least two chambers, e.g. 82 and 84, or 86 and 88, arranged perpendicular to the scanning axis 32. In the illustrated embodiment, the method includes a storing step, where a supply of ink is stored in the printing mechanism 20 separate from the cartridge 50, for delivery to the cartridge chambers 82–88.

Another method is also provided, specifically a method of delivering ink through an inkjet cartridge, which includes the step storing different colors of ink, such as black ink 102, magenta ink 104, yellow ink 106, and cyan ink 108, within plural ink storage chambers of the inkjet cartridge, here within chambers 82–88, respectively. In an ejecting step, the supplied ink is selectively ejected from the cartridge nozzle sets 72–78, with each nozzle set ejecting a single one of the different colors, and with each nozzle set comprising a group of nozzles arranged to have discrete nozzles 80 located to each side of a first plane. Prior to the ejecting step, the nozzle sets 72–78 are supplied with ink by extracting the stored ink 102–108 from the respective ink storage chambers 82–88 through ports 92–98 located on opposing sides of the first plane 90. In the illustrated embodiment, the method includes a step of locating the ports through which ink is extracted on opposing sides of the first plane 90 for adjacent nozzle sets.

Several additional advantages are realized using the cartridge arrangements illustrated herein. For example, the illustrated pen arrangements may be used with a variety of different ink ejection mechanisms, such as piezo-electric or thermal printheads. Furthermore, these pen arrangements may be used with a variety of ink feed designs, such as center feed systems, where the ink is supplied between the linear arrays of nozzles in a given nozzle set, or edge feed systems, where the ink is supplied to the nozzles outboard of each column in a set. A variety of different reservoir back-pressure maintaining systems, such as foam or resilient bladders described above, may be used in these arrangements to prevent ink drool.

Additionally, the smaller width of the illustrated cartridge embodiments advantageously contributes to a smaller product width, resulting in a smaller product "footprint," which refers to the area required to rest the printer on a work surface. In general, such smaller products are more economical, in terms of manufacture and shipping, as well as more compact and desirable to the ultimate consumer. The increased print media throughput realized using the cartridge arrangements illustrated herein is a product feature considered important by many consumers in making purchasing decisions.

I claim:

1. An inkjet printing mechanism, comprising:

a carriage system that reciprocates along a scanning axis in a printzone; and an inkjet cartridge carried by the carriage system, with the cartridge comprising:

a body including four ink storage chambers each containing a supply of ink, with the body having a wall providing a plane which is substantially mutually parallel with the scanning axis, wherein the four ink storage chambers are arranged in a two-by-two matrix comprising a first pair of chambers and a second pair of chambers, with the wall separating the first pair of chambers from the second pair of chambers; and a printhead portion comprising four sets of nozzles with each set of nozzles in fluid communication with an associated one of the four ink storage chambers, with each set of nozzles comprising at least one linear nozzle array, with the linear nozzle array of each of the four sets of nozzles being substantially mutually parallel and intersecting said plane, and with the four sets of nozzles arranged side-by-side in a one-by-four matrix.

2. An inkjet printing mechanism according to claim 1 wherein the linear nozzle array of each of the four sets of nozzles is substantially perpendicular to said plane.

3. An inkjet printing mechanism according to claim 1 wherein the inkjet cartridge further includes four feed ports each coupling one of the four ink storage chambers to an associated one of the four sets of nozzles to provide said fluid communication therebetween.

4. An inkjet printing mechanism according to claim 3 wherein the feed ports for two adjacent nozzle arrays are located on opposing sides of said plane.

5. An inkjet printing mechanism according to claim 1 further including an additional inkjet cartridge, wherein the carriage system receives the cartridge and said additional inkjet cartridge.

6. An inkier printing mechanism according to claim 5, wherein the carriage system provides the relative movement for the the cartridge and said additional inkjet cartridge in a side-by-side orientation wit the scanning axis.

7. An inkjet printing mechanism according to claim 1 wherein the cartridge further comprises four replaceable containers, with each container received within a respective one of the four storage chambers.

8. An inkjet printing mechanism according to claim 1 wherein the cartridge comprises a replaceable cartridge having an ink retaining foam material within each of the storage chambers.

9. An inkjet printing mechanism according to claim 1, further including:

an ink supply system having four separate reservoirs for separately storing four different colors of ink; and a flexible ink transport conduit that delivers the different colors of ink from the four separate reservoirs to the four storage chambers.

10. A method of delivering ink through an inkjet cartridge during transport across a printzone along a scanning axis, comprising the steps of:

storing different colors of ink within the inkjet cartridge, with the cartridge comprising:

a body including four ink storage chambers each containing a supply of one of the different colors of ink, with the body having a wall providing a plane which is substantially mutually parallel with the scanning axis, wherein the four ink storage chambers are arranged in a two-by-two matrix comprising a first pair of chambers and a second pair of chambers, with the wall separating the first pair of chambers from the second pair of chambers; and a printhead portion comprising four sets of nozzles with each set of nozzles in fluid communication with an associated one of the four ink storage chambers, with each set of nozzles comprising at least one linear nozzle array, with the linear nozzle array of each of the four sets of nozzles being substantially mutually parallel and intersecting said plane, and with the four sets of nozzles arranged side-by-side in a one-by-four matrix;

selectively ejecting ink from the four sets of nozzles of the cartridge, with each of the four sets of nozzles ejecting a single one of the different colors; and prior to the ejecting step, supplying the nozzle sets with ink by extracting stored ink from the four ink storage chambers through ports located on opposing sides of said plane.

11. A replaceable pen cartridge for use in an inkjet printing mechanism that provides relative movement between the cartridge and a print media along a scanning axis, comprising:

a printhead body mountable for use in the inkjet printing mechanism, the body including four ink storage chambers each containing a supply of ink, with the body having a wall providing a plane which is substantially mutually parallel with the scanning axis, wherein the four ink storage chambers are arranged in a two-by-two matrix comprising a first pair of chambers and a second pair of chambers, with the wall separating the first pair of chambers from the second pair of chambers; and a printhead portion comprising four sets of nozzles, with each set of nozzles being in fluid communication with a respective one of the storage chambers, and each set of nozzles comprising at least one linear nozzle array, with the linear nozzle array of each of the four sets of nozzles each being substantially mutually parallel and intersecting said plane, and with the four sets of nozzles arranged side-by-side in a one-by-four matrix.

12. A replaceable pen cartridge according to claim 11, further comprising plural replaceable containers of ink, with each container received within a respective one of the four storage chambers.

13. A replaceable pen cartridge according to claim 12, wherein each replaceable container contains ink of a different color selected from a group comprising cyan, yellow, magenta and black.

14. A replaceable pen cartridge according to claim 11, wherein the linear nozzle array of each of the four sets of nozzles is substantially perpendicular to said plane.

15. A replaceable pen cartridge according to claim 11, wherein the inkjet cartridge further includes four feed ports each coupling one of the four ink storage chambers to an associated one of the four sets of nozzles to provide said fluid communication therebetween.

16. A replaceable pen cartridge according to claim 15, wherein the feed ports for two adjacent nozzle arrays are located on opposing sides of said plane.

* * * * *

UNITED STATES PATENT AND TRADEMARK OFFICE

CERTIFICATE OF CORRECTION

PATENT NO. : 5,602,574

DATED : Feb. 11, 1997

INVENTOR(S) : Kenneth R. Williams

It is certified that error appears in the above-identified patent and that said Letters Patent is hereby corrected as shown below:

At column 9, line 40, change "inkier" to --inkjet--.

At column 9, line 43, change "wit" to --with--.

Signed and Sealed this

Fifteenth Day of July, 1997

Bruce Lehman

*Attest:*

BRUCE LEHMAN

*Attesting Officer*

*Commissioner of Patents and Trademarks*